US010092054B2

(12) United States Patent
Williams

(10) Patent No.: US 10,092,054 B2
(45) Date of Patent: Oct. 9, 2018

(54) HELMETS OR OTHER PROTECTIVE HEADGEAR AND RELATED METHODS

(71) Applicant: Albert Williams, San Diego, CA (US)

(72) Inventor: Albert Williams, San Diego, CA (US)

( * ) Notice: Subject to any disclaimer, the term of this patent is extended or adjusted under 35 U.S.C. 154(b) by 204 days.

(21) Appl. No.: 15/088,022

(22) Filed: Mar. 31, 2016

(65) Prior Publication Data

US 2016/0278469 A1 Sep. 29, 2016

Related U.S. Application Data

(63) Continuation-in-part of application No. 29/520,068, filed on Mar. 10, 2015, now Pat. No. Des. 773,742.

(51) Int. Cl.
*A42B 3/00* (2006.01)
*A42B 3/06* (2006.01)

(52) U.S. Cl.
CPC ..... *A42B 3/063* (2013.01)

(58) Field of Classification Search
CPC ..... A42B 3/0406; A42B 3/06; A42B 3/063; A42B 3/068; A42B 3/04; A42B 3/32; A42B 1/205; A42B 3/064
See application file for complete search history.

(56) References Cited

U.S. PATENT DOCUMENTS 1,456,524 A 5/1923 Waldron
1,810,157 A * 6/1931 Bullard ..... A42B 1/02 2/410
2,634,415 A 4/1953 Turner et al.
3,413,656 A 3/1968 Vogliano et al.
3,471,866 A 10/1969 Raney
3,529,306 A 9/1970 Thorne
3,721,994 A 3/1973 DeSimone et al.
4,012,794 A 3/1977 Nomiyama
4,075,715 A 2/1978 Cowgill
D256,626 S 9/1980 Antonino
4,307,471 A 12/1981 Lovell
4,326,303 A 4/1982 Rappleyea
5,671,478 A 9/1997 Yen
5,713,082 A 2/1998 Bassette et al.
5,724,681 A 3/1998 Sykes
5,953,762 A 9/1999 Corbett
6,272,692 B1 8/2001 Abraham
6,314,586 B1 11/2001 Duguid
D459,555 S 6/2002 Gatellet
6,425,141 B1 7/2002 Ewing et al.
D465,067 S 10/2002 Ide
D466,651 S 12/2002 Halstead et al.
D512,534 S 12/2005 Maddux et al.
7,398,562 B2 7/2008 Mollo
D587,854 S 3/2009 Nimmons et al.
D603,099 S 10/2009 Bologna et al.
7,607,179 B2 10/2009 Shih
D625,050 S 10/2010 Chen
D629,162 S 12/2010 Daniel
D654,630 S 2/2012 Chou et al.
(Continued)

*Primary Examiner* — Sally Haden
(74) *Attorney, Agent, or Firm* — Buche & Associates, P.C.; John K. Buche; Bryce A. Johnson

(57) ABSTRACT

Disclosed is a helmet that is aesthetically appealing and that is capable of decelerating impacts from any direction. In a preferred embodiment, the helmet features: a shell with a head cavity that is lined with shock absorbing material, wherein the shell is outfitted with a halo of deceleration plates.

7 Claims, 7 Drawing Sheets

(56) References Cited

U.S. PATENT DOCUMENTS

| | | | | |
|---|---|---|---|---|
| 8,156,569 | B2 | 4/2012 | Cripton et al. | |
| D678,617 | S | 3/2013 | Erb et al. | |
| D681,281 | S | 4/2013 | Bologna et al. | |
| 8,578,520 | B2 | 11/2013 | Halldin | |
| D697,270 | S | 1/2014 | Simpson | |
| D699,895 | S | 2/2014 | Hill et al. | |
| D718,002 | S | 11/2014 | Littrell, Jr. | |
| D734,554 | S | 7/2015 | Crane | |
| 2004/0045078 | A1 | 3/2004 | Puchalski | |
| 2004/0117896 | A1 | 6/2004 | Madey et al. | |
| 2010/0043126 | A1 | 2/2010 | Morel | |
| 2010/0186150 | A1 | 7/2010 | Ferrara et al. | |
| 2011/0179557 | A1 | 7/2011 | Rabie | |
| 2012/0198604 | A1 | 8/2012 | Weber et al. | |
| 2012/0216339 | A1 | 8/2012 | Nimmons et al. | |
| 2012/0297525 | A1 | 11/2012 | Bain | |
| 2014/0189945 | A1 | 7/2014 | Golnaraghi et al. | |
| 2014/0196198 | A1* | 7/2014 | Cohen ..... | A42B 3/063 2/414 |

* cited by examiner

HELMETS OR OTHER PROTECTIVE HEADGEAR AND RELATED METHODS

CROSS-REFERENCE TO RELATED APPLICATIONS

This application is a continuation-in-part of U.S. Des. Pat. App. Ser. No. 29/520,068 (filed Mar. 10, 2015) and entitled "Helmet."

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND AN INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The disclosed subject matter is in the field of helmets and other protective headgear.

Background of the Invention

Helmets and other protective headgear (collectively "helmets") exist to shield or otherwise insulate a wearer's head from forceful impacts during hazardous activities. Structurally, helmets are typically defined by a hard shell that is internally lined with soft, shock-absorbing materials. In a typical mode of use, a wearer positions his or her head inside of the shell so that the head is surrounded by the shock-absorbing material. The hard outer shell of the helmet is intended to deflect the blunt force of an impact while the shock-absorbing material is intended to absorb any remaining forces associated with the impact whereby the head is protected.

Certainly, modern helmets have been satisfactory for protecting the external and skeletal components of the heads of helmet wearers during helmet impacts. However, it has been recently suggested that the internal or non-structural components of the wearer's head are not adequately protected by helmets. The thought is that the abrupt acceleration or deceleration of a wearer's head during an impact causes the brain and other internal organs of the wearer's head to slosh to-and-fro within the brain cavity of the head and sustain trauma via impacting the skeletal or structural components of the wearer's head. Such brain trauma is known to result in concussions of the wearer. Concussions can be particularly problematic during activities, like American football, in which a wearer is continuously subjected to abrupt accelerating/decelerating helmet impacts because chronic traumatic encephalopathy (CTE) (a degenerative disease) may ultimately afflict the helmet wearer.

In view of the foregoing, a need exists for improvements to helmets. Specifically, a need exists for helmets that both (a) protect the wearer's head structure from the blunt force of an impact and (b) smoothly to decelerate the force of an impact so that the non-structural components of a head are protected during the impact. In view of this need, many modifications to helmets have been proposed but ultimately fail to meet the stated need. U.S. Pat. No. 5,724,681 (issued Mar. 10, 1998) by Sykes discloses a "Shock-absorbing helmet cover." Sykes' disclosed improvement is simply an extra protective shell around the helmet which is aesthetically unappealing and does very little to decelerate helmet impacts. Unattractive helmets are problematic because participants in certain activities, like American Football, are image conscious and will not wear an ugly helmet. U.S. Pat. No. 4,307,471 (issued Dec. 29, 1981) by Lovell discloses a "protective helmet" with an outer shell that is slidably connected to the helmet so that the outer shell and the helmet move forward or backward relative to one another during impacts. The relative movements between the outer shell and helmet of Lovell can decelerate head-on impacts, but the outer shell does not adequately protect against side-impacts because the shell can only move forward and backwards relative to the helmet. Thus, a need still exists for improved helmets that are aesthetic and that can decelerate impacts from any direction.

SUMMARY OF THE INVENTION

In view of the foregoing, an object of this specification is to disclose a helmet that is aesthetically appealing and that is capable of decelerating impacts from any direction. In a preferred embodiment, the helmet features: a shell with a head cavity that is lined with shock absorbing material, wherein the shell is outfitted with a halo of deceleration plates. In one embodiment, the deceleration plates are triangular and positioned around the crown of the helmet so that one point of every plate meets generally at the top of the helmet. Suitably, all of the plates are sandwiched at the top of the helmet between a holding plate and the shell, wherein each plate may shift around the contours of the helmet and under the holding plate in response to an impact. In a preferred mode of operation, shifting of the plates is resisted by a gel, e.g., silicone gel. Operably, the plates shift in response to an impact and absorb a portion of the impact energy.

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Disclosed is a helmet that is aesthetically appealing and that is to capable of decelerating impacts from any direction. In a preferred embodiment, the helmet features: a shell with a head cavity that is lined with shock absorbing material, wherein the shell is outfitted with a halo of deceleration plates designed to shift around the contours of the helmet and under the holding plate in response to an impact. The more specific details of the disclosed helmet are disclosed in connection with the attached figures.

Figure 1:
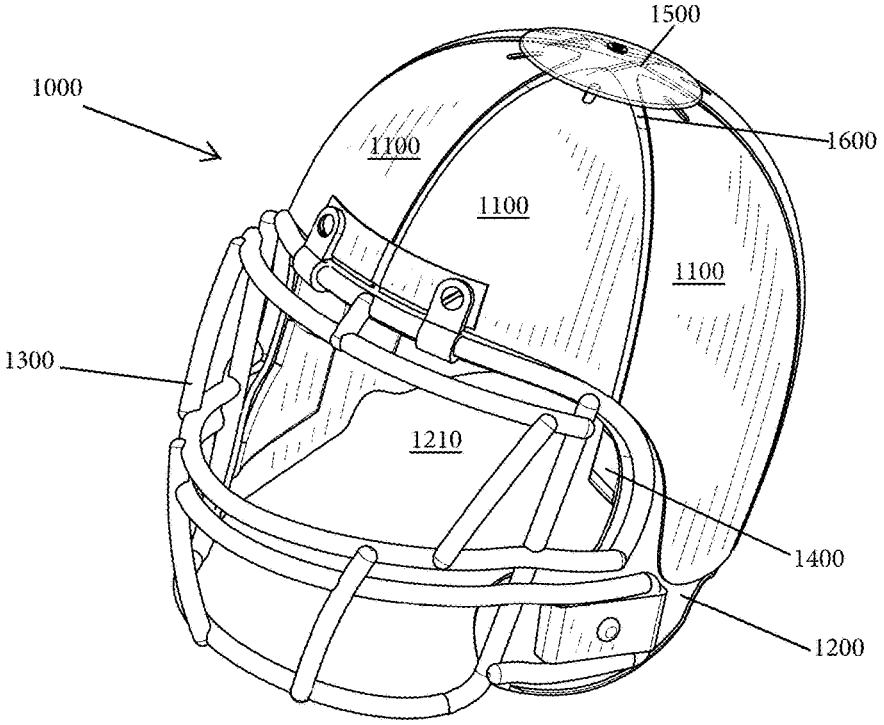
FIG. 1 is an environmental view of a helmet with deceleration plates.
Figure 2:
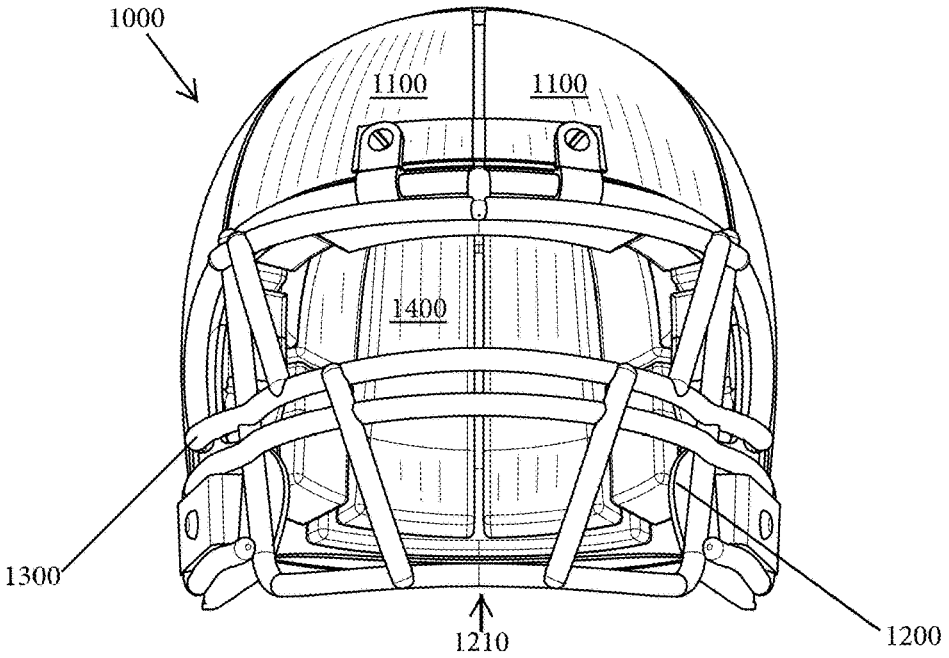
FIG. 2 is a front view of the helmet.
Figure 3:
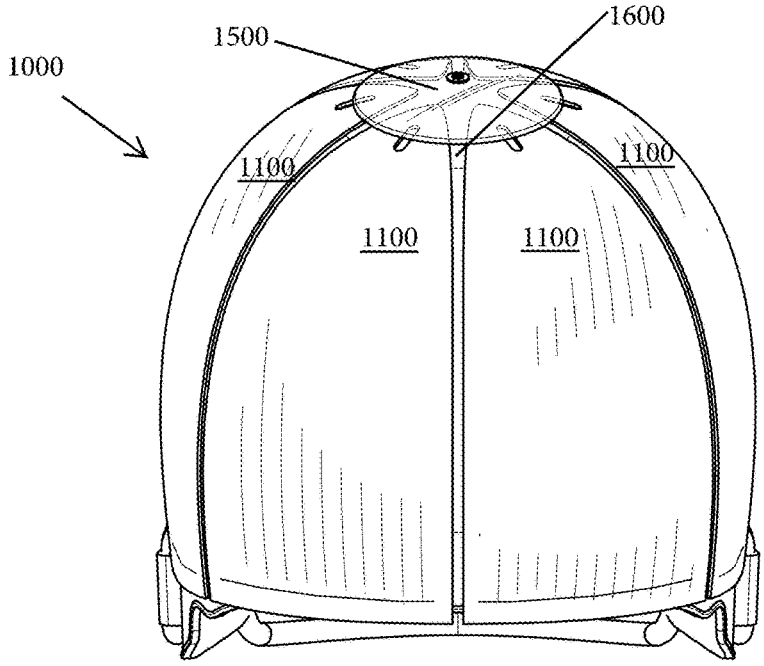
FIG. 3 is a back view of the helmet.
Figure 4:
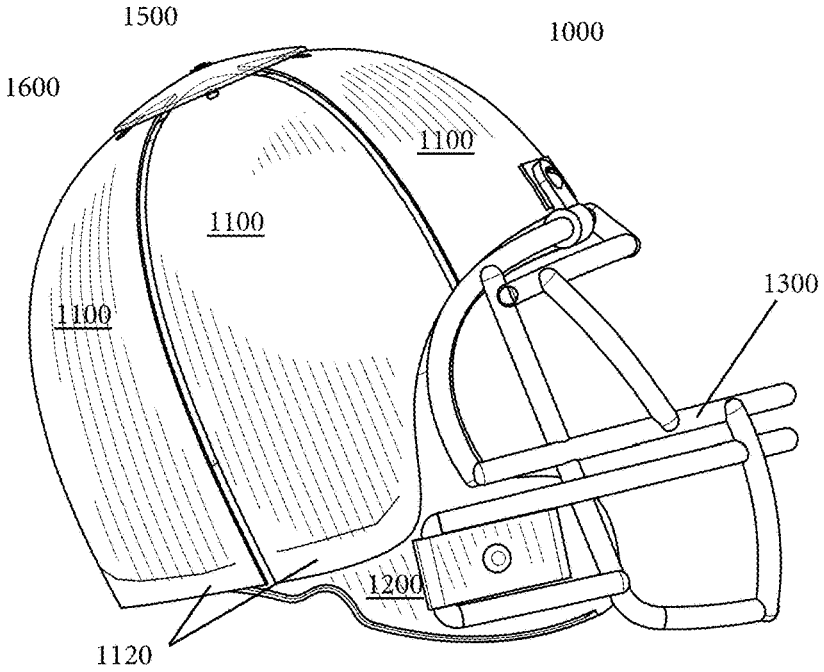
FIG. 4 is a left-side view of the helmet.
Figure 5:
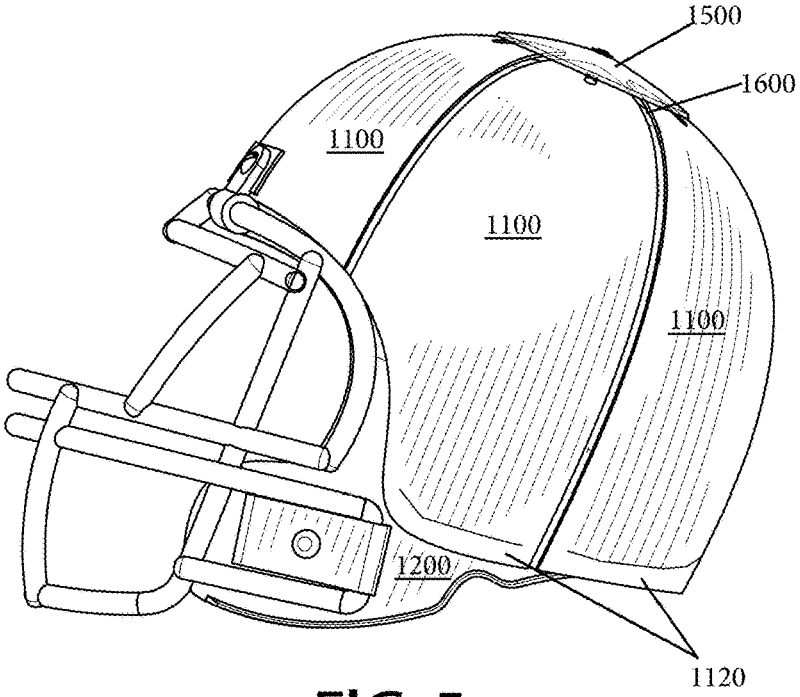
FIG. 5 is a right-side view of the helmet.
Figure 7:
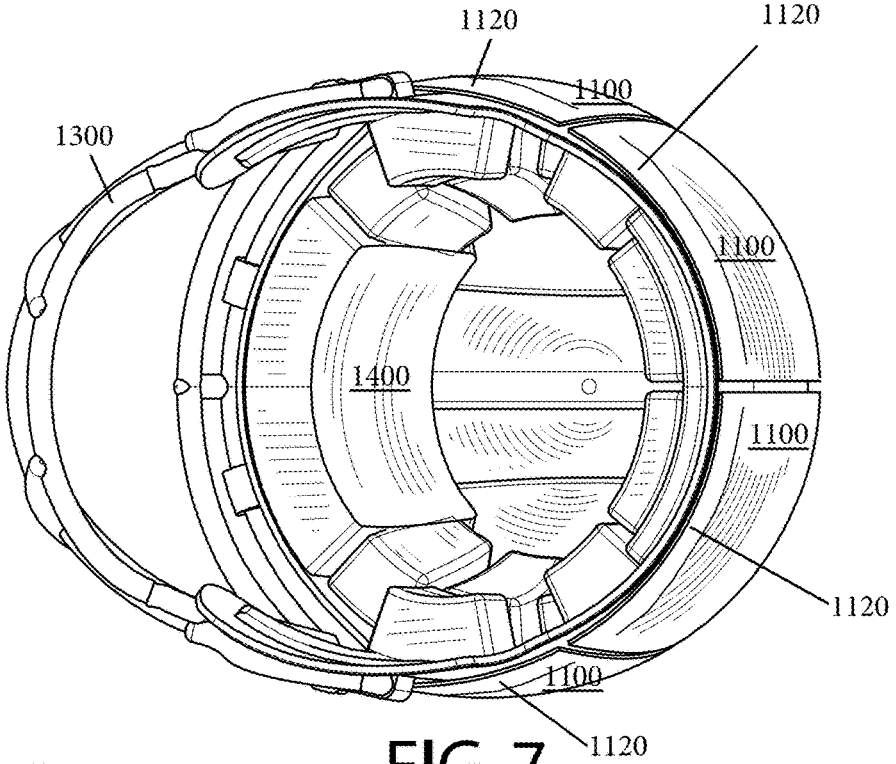
FIG. 7 is a top view of the helmet.
Figure 6:
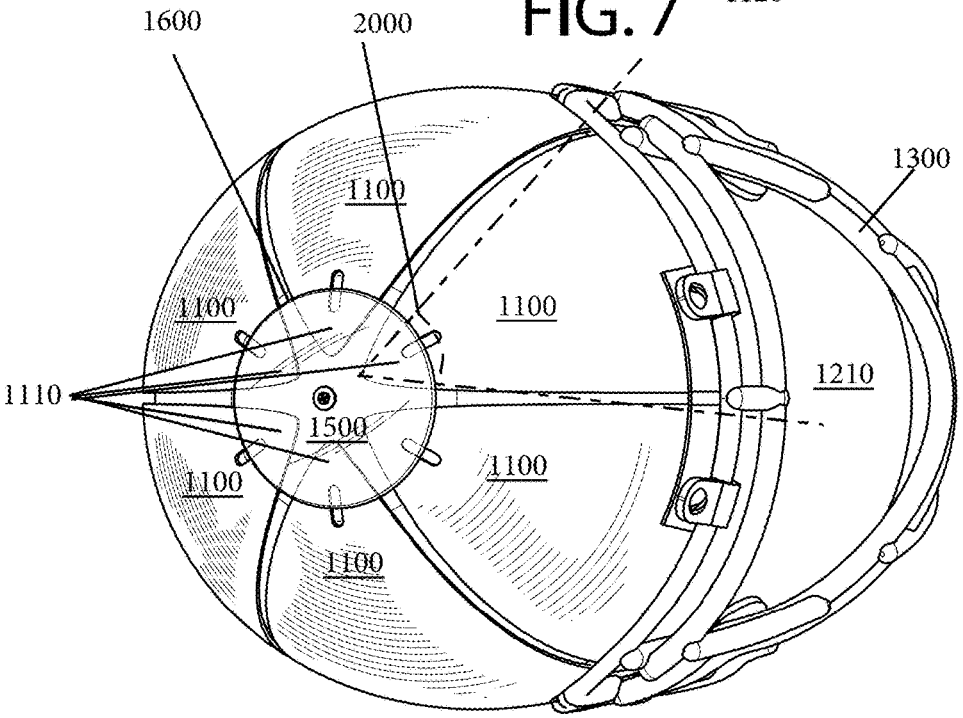
FIG. 6 is a bottom view of the helmet.

FIG. 1 is an environmental view of a helmet 1000 with deceleration plates 1100. FIGS. 2 through 7 are respectively a front view, a back view, a left-side view, a right-side view, a bottom view, and a top view of the helmet 1000 with deceleration plates 1100. As shown, the preferred embodiment of the helmet 1000 features: a shell 1200 with a head cavity 1210 that is lined with shock-absorbing padding 1400; a facemask 1300; a holding plate 1500; a halo of deceleration plates 1100 designed to shift around the contours of the helmet and under the holding plate 1500 in response to an impact; and shock absorbing gel 1600 for resisting the shifting of the plates 1100 to under the holding plate 1500.

Still referring to FIGS. 1 through 7, the deceleration plates 1100 are some-what triangular and molded around the helmet so that one point 1110 of every plate 1100 meets generally at the top of the helmet 1100. See, e.g., FIG. 6. In the preferred embodiment, five or six some-what triangular carbon-fiber plates 1100 are employed wherein the point 1110 has an angle 2000 (FIG. 6) of approximately 60 to 72 degrees. More or less than five or six plates may be used, but five or six is preferable. In on embodiment, each plate 1100 features a foot 1120 by which the plate 1100 may be rigidly secured to the shell 1200 around the perimeter of the head cavity 1210 of the shell 1200. See FIGS. 4, 5 and 7. In the preferred embodiment, the plates 1100 bulge outwardly from the foot 1120 so that an airspace 1130 (not shown until FIG. 8) is provided between the shell 1200 and the plate 1100. The air space 1130 (not shown until FIG. 8) is discussed in greater detail below in connection with FIG. 8. Suitably, all of the plates 1100 are slidably held at the at the top of the helmet 1000 between a holding plate 1500 and the shell 1200, wherein, as discussed further below, each plate 1100 may shift around the contours of the helmet 1000 and under the holding plate 1500 in response to an impact. In a preferred mode of operation, shifting of the plates is resisted by a gel 1600, e.g., silicone gel, that is sandwiched between the holding plate 1500 and the shell 1200.

Figure 8:
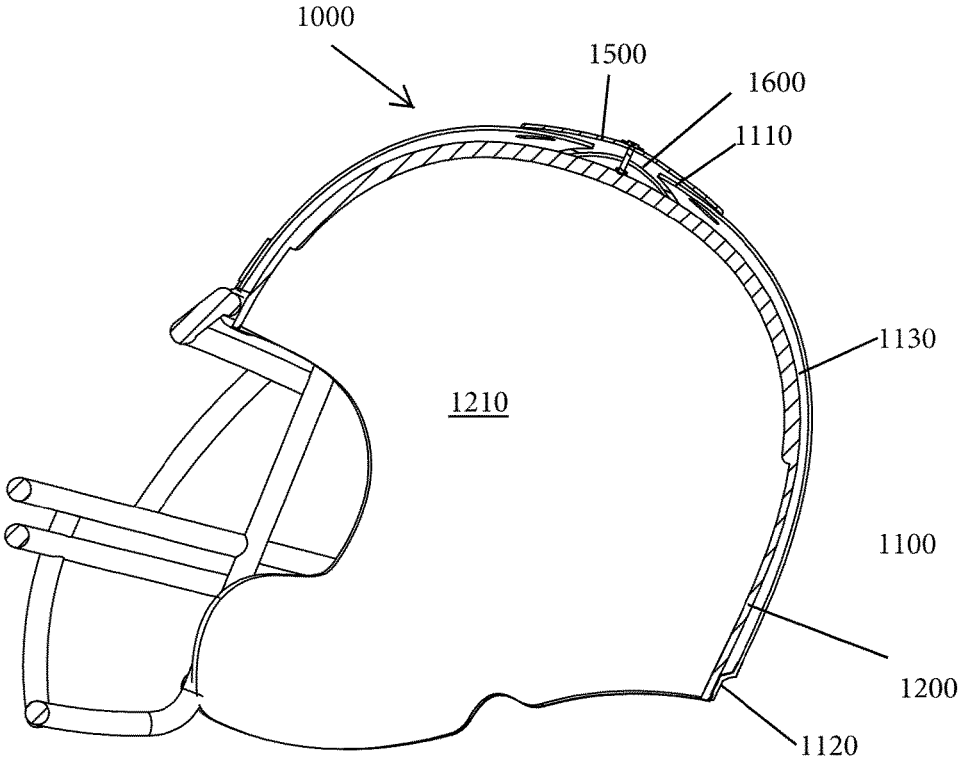
FIG. 8 is a cross section of the helmet, which illustrates an air space between the declaration plates and a protective surface of the helmet.

FIG. 8 is a cross section of the helmet 1000. FIG. 8 illustrates an air space 1130 between the deceleration plates 1100 and the shell 1200 or to protective surface of the helmet 1000. As discussed above, each plate 1100 may feature a foot 1120 by which the plate 1100 may be rigidly secured to the shell 1200 around the perimeter of the head cavity 1210 of the shell 1200. From the foot 1120, the plates 1100 bulge slightly outwardly so that the airspace 1130 is provided between the shell 1200 and the plate 1100. Suitably, all of the plates 1100 are slidably held at the at the top of the helmet 1000 between a holding plate 1500 and the shell 1200, wherein, as discussed further below, each plate 1100 may shift around the contours of the helmet 1000 and under the holding plate 1500 in response to an impact. Suitably movement of the plates under the holding plate 1500 is resisted by the gel 1600. In one embodiment, the tip 1110 may feature a track or cutout so that the movement of the deceleration plates 1100 may be guided.

Figure 9:
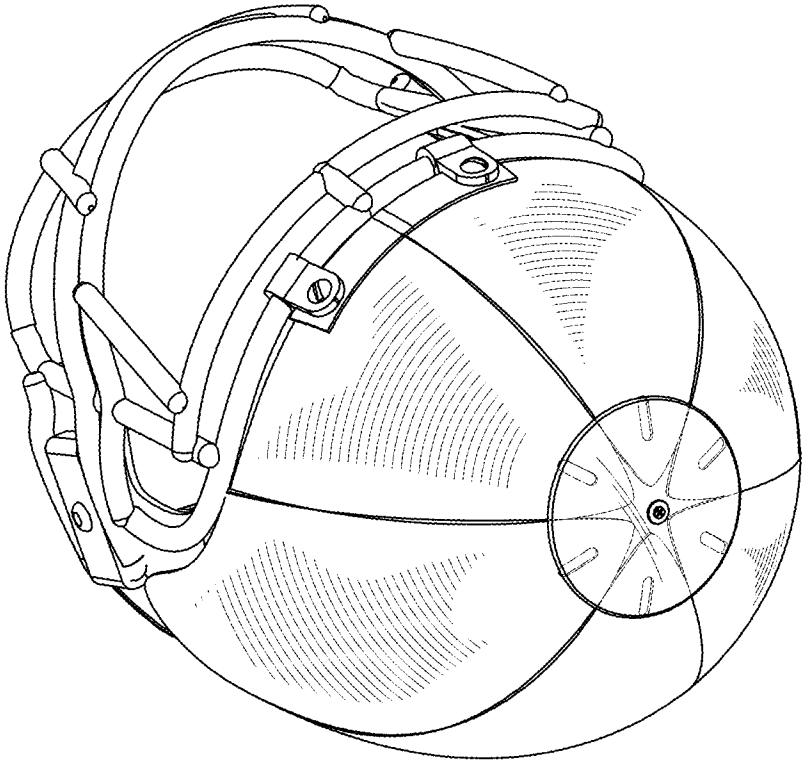
FIG. 9 is an environmental view of the helmet with deceleration plates compressed towards one another; and, FIG. 10 is a diagram.
Figure 10:
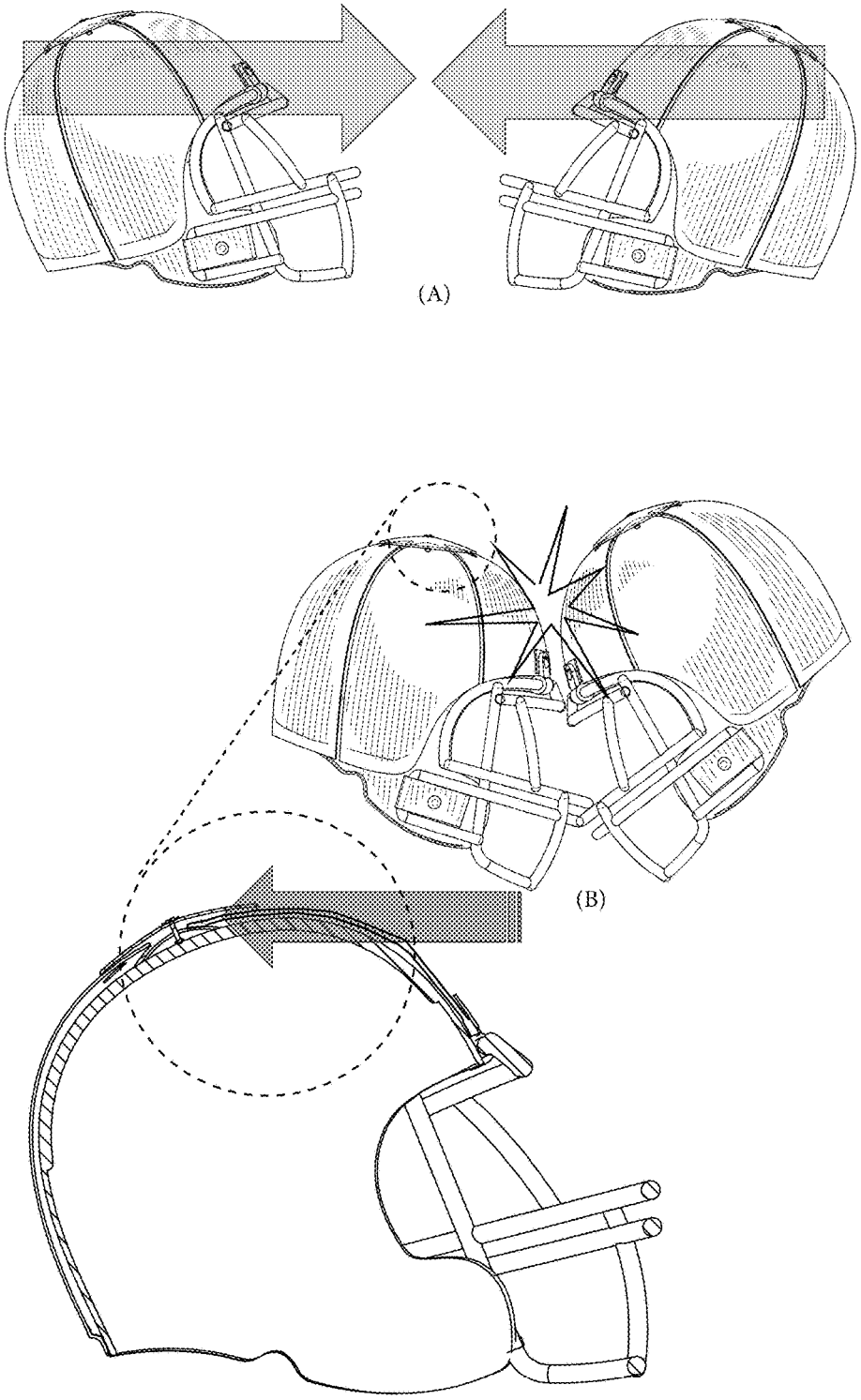

FIG. 9 is an environmental view of the helmet 1000 with deceleration plates 1100 compressed towards one another. As discussed above, the deceleration plates 1100 may shift around the contours of the helmet 1000 and under the holding plate 1500 in response to an impact. Referring to FIGS. 1, 8 and 9, the plates 1100 deflect from the position shown in FIG. 1 toward and underneath the holding plate 1500 in response to an impact. The result is the position shown in FIG. 9, where every plate 1100 has been deflected under the holding plate 1500. Referring now to FIG. 8, during said deflection, the air space 1130 (FIG. 8) is reduced. Suitably, the movement of the deflecting plates 1100 decelerates the impact. It should be noted that, even though all of the deceleration plates 1100 are shown as deflected under the holding plate 1500 at the same time, it is contemplated that one or more of the deceleration plates 1100 may be deflected by itself or with multiple plates 1100 being deflected from a single impact. FIG. 10 is a diagram of a typical use for the helmet 1000 disclosed. As shown in the figure, when two helmets (A) are impacted (B) the deceleration plate 1100 are moved within the holding plate 1500.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus to the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

I claim:

1. A helmet comprising:

a shell with a head cavity where the shell is further defined externally by a crown and a contoured outer surface that is contiguous with the crown and a perimeter of the head cavity;

a holding plate rigidly secured to the shell (a) externally relative to the head cavity and (b) centrally relative to the crown of the shell;

a plurality of deceleration plates, where each deceleration plate is defined by a point, a foot, and a bulging surface that is contiguous between the point and foot; and, wherein the shell is outfitted with a halo that has been formed of said plurality of deceleration plates by rigidly securing the foot of each deceleration plate to the perimeter of the head cavity and slidably positioning the point of each deceleration plate in between the crown and holding plate so that said bulging surface of each plate is positioned over a portion of said contoured outer surface whereby deflecting the bulging surface of any one of said plurality of deflection plates toward a corresponding portion of the contoured surface via an impact on the said one deceleration plate causes the point of said one deceleration plate to slide between the holding plate and crown while the foot of said one deceleration plate is held fast at the perimeter of the head cavity.

2. The helmet of claim 1 wherein each of the plurality of deceleration plates are triangular and positioned around the crown of the shell (A) so that an air space is created between the bulging surface of each of the plurality of deceleration plates and the corresponding portion of said contoured outer surface and (B) so that said point of every one of said plurality of deceleration plates meet centrally at the crown between said crown and said holding plate.

3. The helmet of claim 2 further comprising gel between the holding plate and the crown of the shell so that shifting of the plates is resisted by the gel.

4. The helmet of claim 3 wherein the head cavity is lined with shock-absorbing substances.

5. A method of protecting the head of a wearer comprising the steps of:

placing the head of the wearer into a head cavity of a shell where the shell is further defined externally by a crown and a contoured outer surface that is contiguous with the crown and a perimeter of the head cavity;

providing at least one deceleration plate by rigidly securing a foot of said deceleration plate to the perimeter of the head cavity and slidably positioning a distal point of said at least one deceleration plate in between a holding plate and the crown of the head cavity so that a surface of said at least one deceleration plate comprises a bulging surface that is contiguous between the point and foot;

allowing said at least one deceleration plate to deflect in response to an impact so that movement of said at least one deceleration plate is resisted as said distal point is secured so that said distal point moves underneath the holding plate.

6. The method of claim 5 where the movement of the distal end of said at least one deceleration plate underneath the holding plate is resisted by a shock absorbing gel.

7. The method of claim 5 where the deceleration plate is carbon fiber.

* * * * *